United States Patent [19]

Eisenbacher et al.

[11] Patent Number: 4,527,460

[45] Date of Patent: Jul. 9, 1985

[54] RADIAL PISTON MACHINE

[75] Inventors: Egon Eisenbacher, Karlstadt, Fed. Rep. of Germany; Sinclair Cunningham, Kinghorn, Scotland; Peter Wüsthof, Lohr/Main, Fed. Rep. of Germany; Sinclair Cunningham, Kinghorn, Scotland

[73] Assignee: Mannesmann Rexroth GmbH, Lohr/Main, Fed. Rep. of Germany

[21] Appl. No.: 445,034

[22] Filed: Nov. 29, 1982

[30] Foreign Application Priority Data

Nov. 28, 1981 [DE] Fed. Rep. of Germany ..... 3147240

[51] Int. Cl.[3] ..... F01B 15/04; F01B 1/06; F04B 29/00

[52] U.S. Cl. ..... 91/491; 92/118; 417/460; 417/464

[58] Field of Search ..... 92/118; 417/460; 91/491-496

[56] References Cited

U.S. PATENT DOCUMENTS

| | | | |
|---|---|---|---|
| 2,956,845 | 10/1960 | Wahlmark | 92/110 |
| 3,040,716 | 6/1962 | Hahn | 91/498 |
| 3,320,902 | 5/1967 | Paschke | 417/460 |
| 3,945,766 | 3/1976 | Gelon | 91/118 |

FOREIGN PATENT DOCUMENTS

| | | | |
|---|---|---|---|
| 1943163 | 8/1969 | Fed. Rep. of Germany . | |
| 1653368 | 2/1970 | Fed. Rep. of Germany | 91/491 |
| 2425050 | 12/1974 | Fed. Rep. of Germany | 91/491 |
| 24108 | 3/1978 | Japan | 91/491 |

*Primary Examiner*—William L. Freeh
*Attorney, Agent, or Firm*—Michael J. Striker

[57] ABSTRACT

A radial piston machine has a cylindrical housing which encloses a rotary shaft formed with an eccentric. A plurality of stationary piston rods is connected to the inner wall of the housing and radially directed toward the shaft. The free ends of piston rods are provided with ball-and-socket joints permitting universal rotary movement of the pistons. Each piston slidably engages the inner wall of an assigned cylinder which at its bottom wall slidably engages the eccentric. In a modification, the spherical surface of the stationary ball joint directly engages the inner wall of the cylinder.

4 Claims, 3 Drawing Figures

RADIAL PISTON MACHINE

BACKGROUND OF THE INVENTION

The present invention relates in general to radial piston machines, such as radial piston pumps or radial piston engines, and in particular to a machine of the type having a housing enclosing a rotary shaft formed with an eccentric, a plurality of radial pistons provided with stationary connecting rods and with movable cylinders slidably engaging the eccentric and being guided in radial direction by the pistons.

In a prior-art radial piston machine of the above described type, the hollow pistons are supported in the housing by spherical or cup-shaped elements engaging the ends of the pistons which are remote from the rotary shaft. Such a prior-art machine is disclosed for example in the German patent publication No. 19 43 163. This arrangement requires an increased space occupied by the machine; nonetheless, the effective value of the cylinder-and-piston units utilized during the operation of the machine is relatively small.

SUMMARY OF THE INVENTION

It is therefore a general object of the present invention to overcome the aforementioned disadvantages.

More particularly, it is an object of the invention to provide an improved radial piston machine which has a compact construction and reduced weight.

Another object of this invention is to provide such an improved machine in which the mass of the movable cylinders is reduced.

A further object of the invention is to provide such an improved machine in which the effective volume of the cylinder-and-piston unit is increased.

Another object of the invention is to provide a radial piston machine which is simple and economical in manufacture.

In keeping with these objects, and others which will become apparent hereinafter, one feature of the invention resides in a radial piston machine of the aforedescribed kind, in the provision of pistons which are provided with connecting rods fixedly secured at one end thereof to the housing and being each slidably connected to the piston by a ball-and-socket joint, and the corresponding movable cylinders are slidably guided by the pistons and slidably engage the eccentric.

By virtue of the fixedly mounted connecting rods, the point of rotation of the cylinders can be arranged in radial direction considerably closer to the rotary shaft. As a result, short and compact cylinders of low mass can be employed. Similarly, the mass of the movable parts of the pistons can be comparatively low, and it is possible to design the pistons even without movable parts. The volume of the cylinder-and-piston units which is ineffective for the actual operation of the machine is also greatly reduced. The overall construction of the machine is compact and can be manufactured at a relatively low cost.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

A substantially cylindrical machine housing 1 encloses a rotary shaft 2 formed with an eccentric 3. The cylindrical surface of eccentric 3 slidably engages correspondingly curved bottoms of five hollow cylinders 4*a* through 4*e*. A corresponding number of stationary connecting rods 5*a* through 5*e*, fixedly mounted on the housing 1, support on their free ends ball joints 7*a* through 7*e* and correspondingly shaped spherical sockets in pistons 8*a* through 8*e*. The cylindrical jackets of respective pistons slidably engage the inner walls of respective cylinders 6*a* through 6*e*. In this embodiment, housing 1 is formed with radially directed cylindrical attachments 6*a* through 6*e* communicating with the interior of housing 1 and each supporting at the center of its outer base one of the connecting rods 5*a* through 5*e*.

Figure 2:
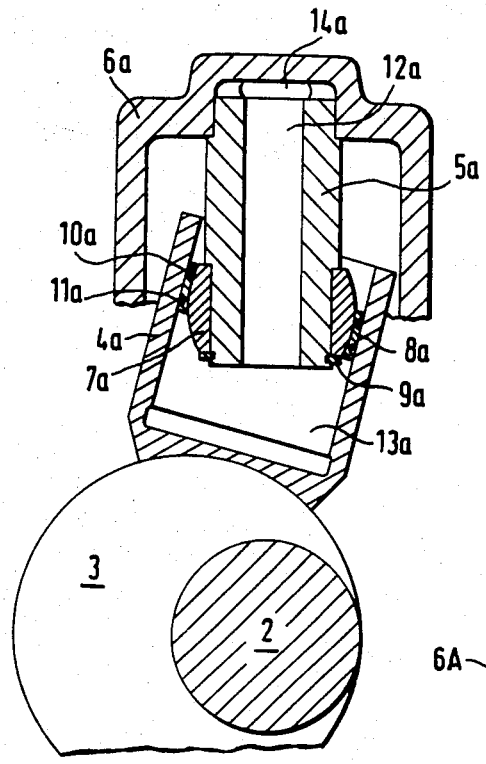
FIG. 2 is a sectional side view of a cut away part of the machine of FIG. 1, shown on an enlarged scale.

Referring now to the embodiment according to FIG. 2, the ball joint 7*a* has an annular configuration and is inserted on a reduced free end portion of the connecting rod 5*a* and rests on a flange of the latter. A snap ring 9*a* holds the ball joint in position. The piston 8*a* is provided with sealing rings 10*a* and 11*a* for sealing the gaps between the jacket of the piston and the inner wall of the cylinder 4*a*. The connecting rod 5*a* is formed with a throughgoing axial passage 12*a* connecting the working volume 13*a* of the cylinder-and-piston unit with a control channel 14*a* arranged in the top of the cylindrical housing attachment 6*a*. The remaining cylinder-and-piston units are constructed in the same fashion. The control channels 14*a* communicate with a non-illustrated rotary slider secured to the shaft 2 and this slider alternately connects the working volume of respective cylinder-and-piston units to an intake or discharge channel, depending on whether the machine operates as a radial piston engine or as a radial piston pump.

Figure 1:
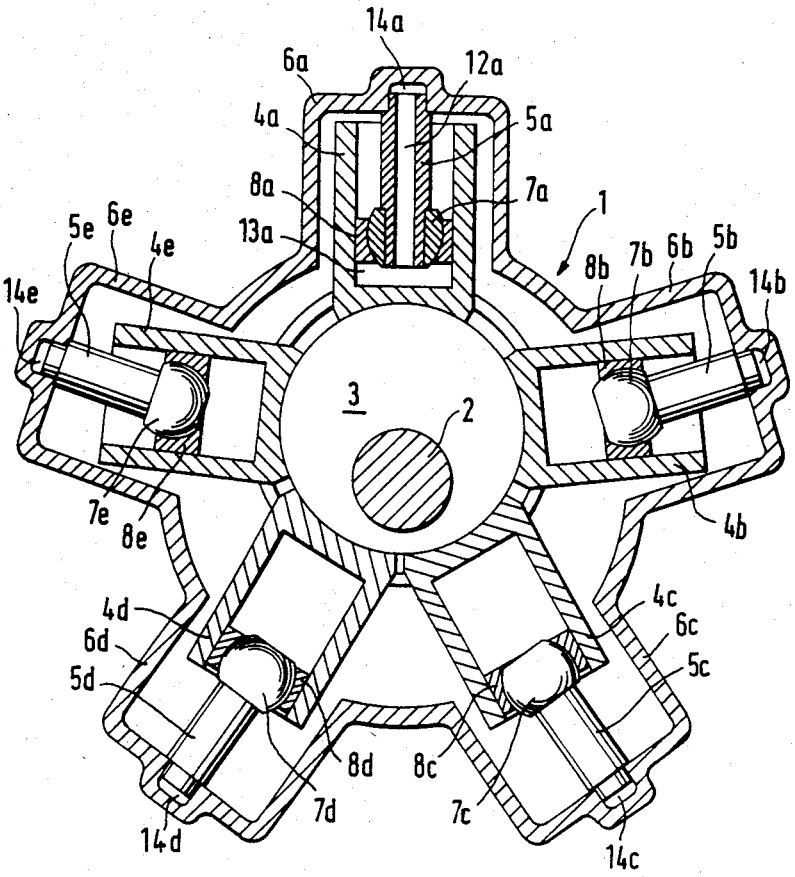
FIG. 1 is a sectional side view of the radial piston machine according to this invention.

Referring again to FIG. 1, the radial cylinder-and-piston unit 4*a* and 8*a* is illustrated in its full compression stroke, in which the working space 13*a* is minimum. After the turning of the shaft 2 about an angle of 180° C., the eccentric 3 displaces the movable cylinder 4*a* relative to the piston 8*a* to its maximum suction stroke near the top-dead-center point, as depicted in cylinder-and-piston units 4*c*, 8*c* and 4*d*, 8*d*. The intermediate positions of the piston strokes will be seen in cylinder-and-piston units 4*b*, 8*b* and 4*e*, 8*e*.

Figure 3:
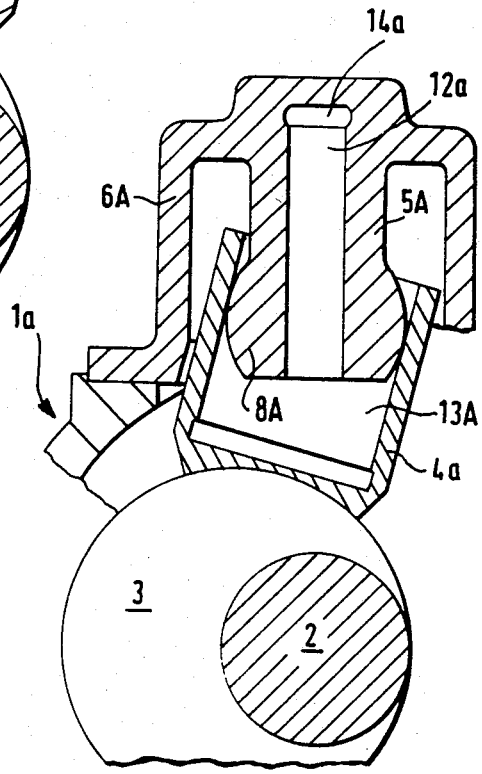
FIG. 3 is a modification of the part of FIG. 2.

In a modification depicted in FIG. 3, similar component parts are indicated by like reference numerals, the modifications being indicated by capital letters. In this embodiment, machine housing 1*a* is provided with radial attachments 6A formed as one piece together with the connecting rod 5A and the ball joint 8A. Similarly as in the preceding example, the connecting rod 5A is provided with a central passage 12A and with a control channel 14A for the working fluid. The blind bore of cylinder 4A engages directly the convex spherical surface of the ball joint 8A, so that the cylindrical movable part of the piston is dispensed with. The operation of the cylinder-and-piston unit 4*a*, 8A is the same as in the preceding example.

It will be understood that each of the elements described above, or two or more together, may also find a useful application in other types of constructions differing from the types described above.

Without further analysis, the foregoing will so fully reveal the gist of the present invention that others can, by applying current knowledge, readily adapt it for various applications without omitting features that, from the standpoint of prior art fairly constitute essential characteristics of the generic or specific aspects of this invention.

What is claimed as new and desired to be protected by Letters Patent is set forth in the appended claims.

We claim:

1. A radial piston machine comprising a housing formed with control channels and enclosing a rotary shaft formed with an eccentric; a plurality of radial pistons each having a cylindrical outer wall and a spherical socket; a corresponding plurality of radially directed connecting rods each having a central throughgoing passage, each fixidly secured at one end thereof to the housing so that the central passage communicate with the respective control channels, and each forming at its opposite end together with the spherical socket of the assigned piston a ball-and-socket joint with one pair of spherical sliding surfaces; a pair of spherical sliding surfaces being mounted on the periphery of said spherical socket; a corresponding plurality of cylinders each having a bottom portion which slidably engages said eccentric, an inner wall which slidably engages the cylindrical outer wall of the assigned radial piston and forms together therewith a pair of cylindrical sliding surfaces, so that two different pairs of sliding surfaces are formed thus providing essential high pressure sealing between each of said radial pistons and each of said cylinders.

2. A radial piston machine as defined in claim 1, wherein said housing has a substantially cylindrical configuration and said radial connecting rods are inserted in the inner cylindrical wall of the housing.

3. A radial piston machine as defined in claim 1, wherein said housing includes a plurality of cylindrical attachments each having its center axis directed radially to said shaft and an inner diameter which exceeds the outer diameter of said cylinders, and said rods being coaxially mounted in said attachments.

4. A radial piston machine as defined in claim 1, wherein each piston is provided with at least one sealing ring to seal the gap between the outer wall of the piston and the inner wall of the cylinder.

* * * * *